US006919692B2

(12) United States Patent
MacBain et al.

(10) Patent No.: US 6,919,692 B2
(45) Date of Patent: Jul. 19, 2005

(54) CONTROL DEVICE OF GAS-DISCHARGE LIGHT SOURCE

(75) Inventors: Alexander MacBain, Ayr (GB); Aleksey Konstantinovich Bui Anov, Moscow.obl. (RU); Yevgeniy Aleksandrovich Yermakov, Moscow.obl. (RU); Konstantin I vovich Orlov, Moscow (RU); Vasiliy Sergeyevich Stupishin, Moscow (RU); Boris Viktorovich Uryvskiy, Moscow.obl. (RU)

(73) Assignee: OOO "Dependable Electronic Converter Systems", RU, Moscow (RU)

( * ) Notice: Subject to any disclaimer, the term of this patent is extended or adjusted under 35 U.S.C. 154(b) by 0 days.

(21) Appl. No.: 10/415,110

(22) PCT Filed: Dec. 1, 2000

(86) PCT No.: PCT/RU00/00495

§ 371 (c)(1),
(2), (4) Date: Jul. 2, 2003

(87) PCT Pub. No.: WO02/37902

PCT Pub. Date: May 10, 2002

(65) Prior Publication Data

US 2004/0051477 A1 Mar. 18, 2004

(30) Foreign Application Priority Data

Nov. 1, 2000 (RU) ..... 2000127419

(51) Int. Cl.[7] ..... H05B 37/02

(52) U.S. Cl. ..... 315/219; 315/224; 315/307

(58) Field of Search ..... 315/224, 307, 315/219

(56) References Cited

U.S. PATENT DOCUMENTS 5,049,790 A * 9/1991 Herfurth et al. ..... 315/291

FOREIGN PATENT DOCUMENTS

EP 0374617 B1 6/1990

OTHER PUBLICATIONS

Abstract of JP6013977 published Jan. 21, 1994 (NEC Corp).

* cited by examiner

*Primary Examiner*—David Vu
(74) *Attorney, Agent, or Firm*—Jacobson Holman PLLC

(57) ABSTRACT

The essence of the invention: a control device of gas-discharge light source having a resonance circuit with connection of a choking coil and capacitor made branched, a starting switch, an ignition pulse generator, power-supply mains, a control-and-command circuit with a microprocessor control unit having a line-operated telemetric receiver and transmitter interacting with a unit of timing and detector of frequency-modulated signals, elements of load state control, elements of current and voltage monitoring.

4 Claims, 5 Drawing Sheets

CONTROL DEVICE OF GAS-DISCHARGE LIGHT SOURCE

BACKGROUND OF THE INVENTION

1. Field of the Invention

This invention relates to electrical engineering and, in particular, to supply devices for gas-discharge light sources.

2. Description of Related Art

Control devices of a gas-discharge light source containing a gas-discharge lamp as a load, resonance circuit functionally coupled to the load, igniting elements of the gas-discharge lamp with a controlled starting switch, power-supply mains and a control unit are known (JP, No. 6013977, H 02 M 7/48, 1985).

Known devices have a limited adjustment range due to application of a stiff logic function of control.

A more perfect and the closest analogue of the applied invention is a control device of a gas-discharge light source having a gas-discharge lamp as a load, resonance circuit in the form of a choking coil and capacitor functionally coupled to the load, an ignition pulse generator with a power controlled switch and L element coupled to the load, power-supply mains and control-and-command circuit formed by a microprocessor control unit with a driving pulse oscillator, elements of load state control, elements of current and voltage monitoring in power-supply mains and a starting switch with control driver of a switching element (U.S. Pat. No. 5,049,790, H 05 B 41/00, 1991).

SUMMARY OF THE INVENTION

The deficiency of the above device is low mass-dimension and power figures owing to the need to mismatch a resonance circuit and driving oscillator for stabilization of load parameters.

A technical result of the present invention is to increase reliability and to improve mass-dimension and power figures.

This result is obtained with the control device of a gas-discharge light source including a gas-discharge lamp as a load, resonance circuit in the form of a choking coil and capacitor functionally coupled to the load, an ignition pulse generator with a power controlled switch and L element coupled to the load, power-supply mains and control-and-command circuit formed by a microprocessor control unit with a driving pulse oscillator, elements of load state control, elements of current and voltage monitoring in power-supply mains and a starting switch with control driver of a switching element; due to the fact that the device is provided with a unit of timing with power-supply mains and detector of frequency-modulated signals inductively coupled to the timing unit and galvanically connected to the microprocessor control unit; in so doing the microprocessor control unit is made with a line-operated telemetric receiver coupled to the lead terminal of the detector of frequency-modulated signals having output receiving buffer, and with the line-operated telemetric transmitter coupled to the lead terminals of the unit of timing with power-supply mains having input transmitting buffer; and functional connection of the choking coil and the capacitor of the resonance circuit with the load is made branched.

As well as due to the fact that the L element of the ignition pulse generator is designed in the form of a transformer, in this case the secondary transformer winding is coupled in series to the choking coil of the resonance circuit and the load.

Along with the fact that the L element of the ignition pulse generator is made in the form of an inductance coil, in this case the choking coil of the resonance circuit is coupled in series to the load and inductively coupled to the inductance coil.

Together with the fact that the L element of the ignition pulse generator and the choking coil of the resonance circuit are designed in the form of transformers, in this case the primary winding of the choking coil is coupled inductively to the load and the secondary winding of the L element.

And also owing to the fact that the L element of the ignition pulse generator is designed in the form of a transformer, in this case secondary transformer winding is coupled in series to the load and the resonance circuit capacitor.

BRIEF DESCRIPTION OF THE DRAWINGS

The nature of the present invention is shown in Figures, where:

the circuit diagram of device with the L element of the ignition pulse generator designed in the form of a transformer, in this case the secondary transformer winding, is coupled in series to the choking coil of the resonance and the load is given in FIG. 1;

Figure 2:
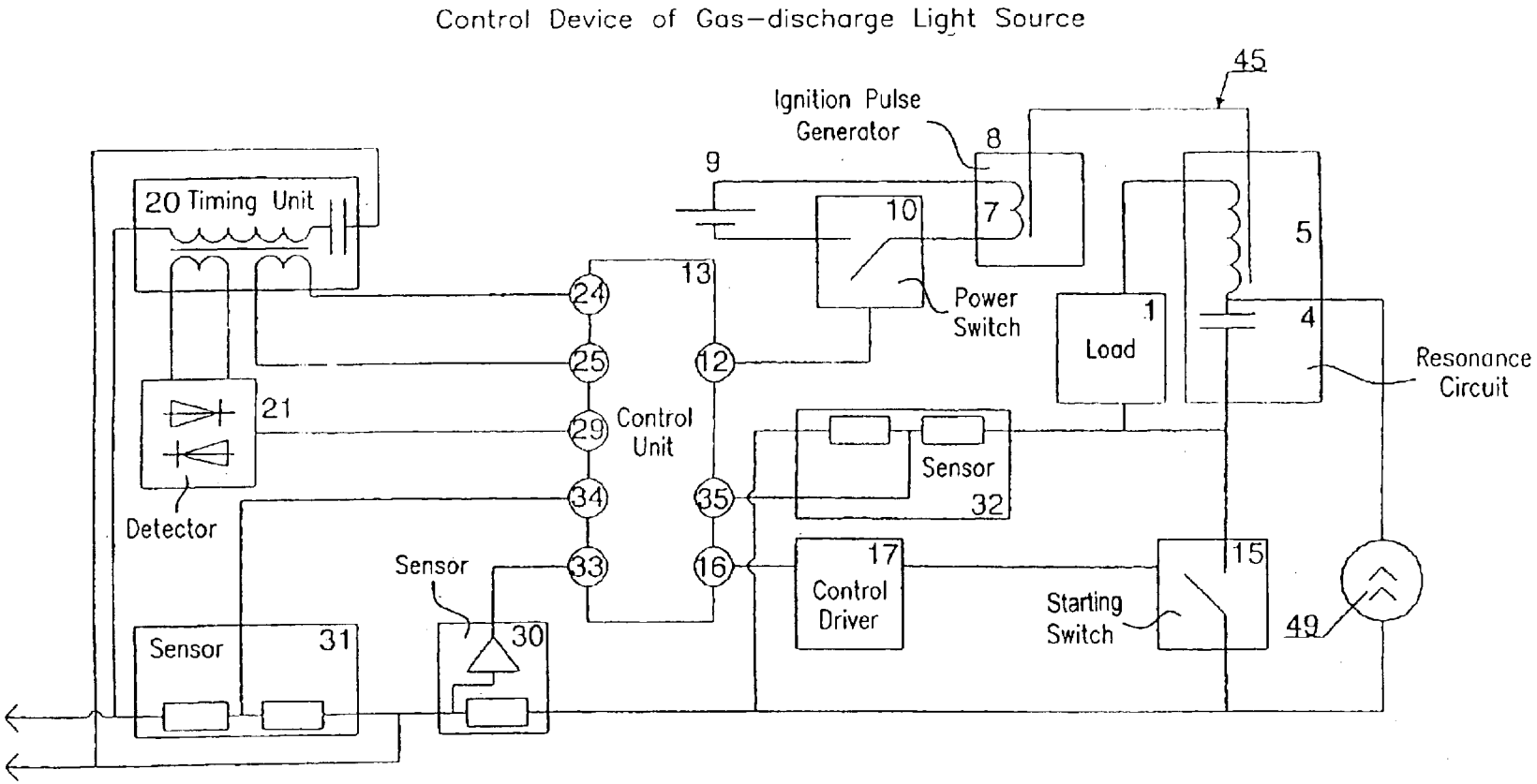
Figure 3:
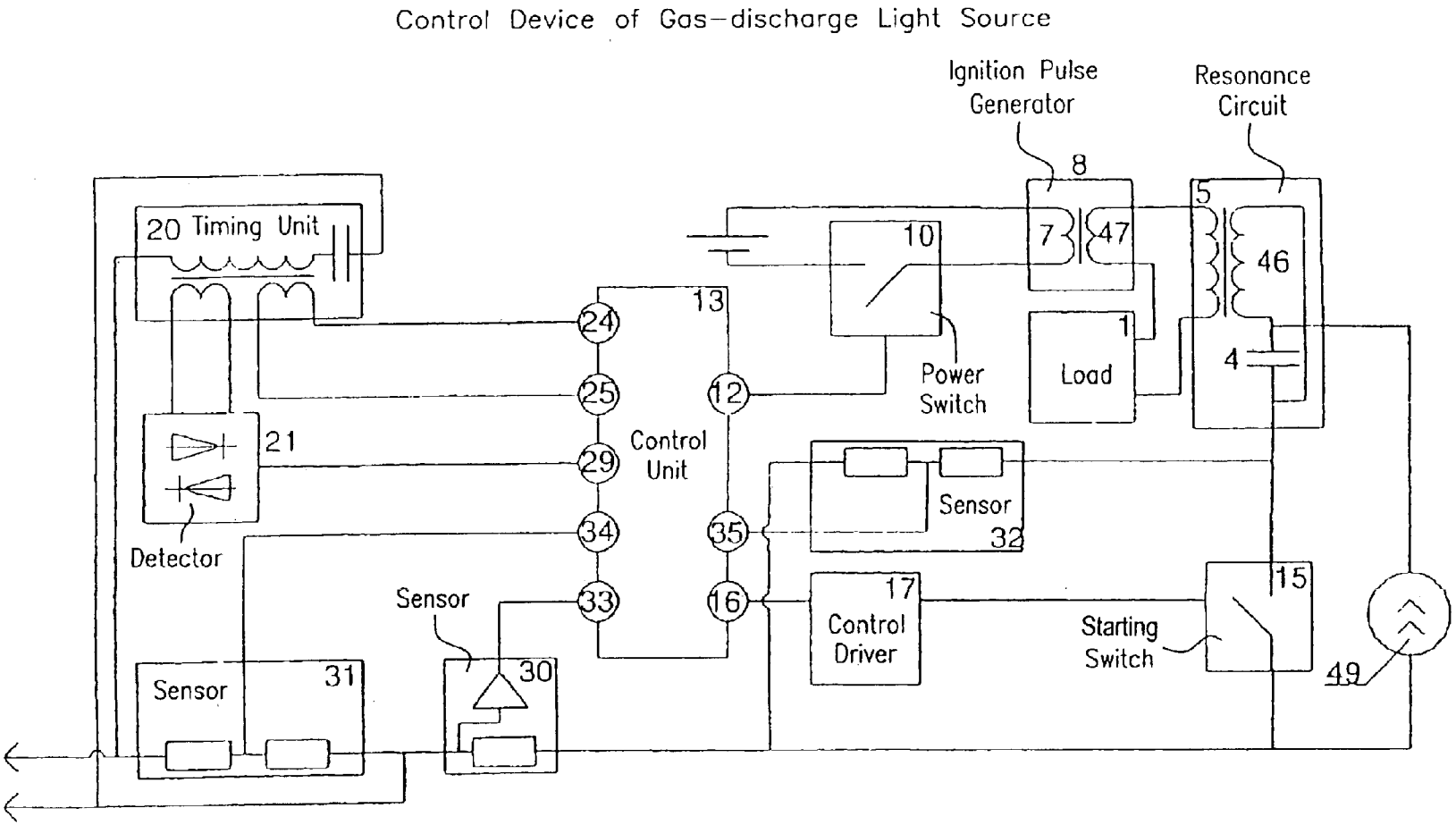
Figure 4:
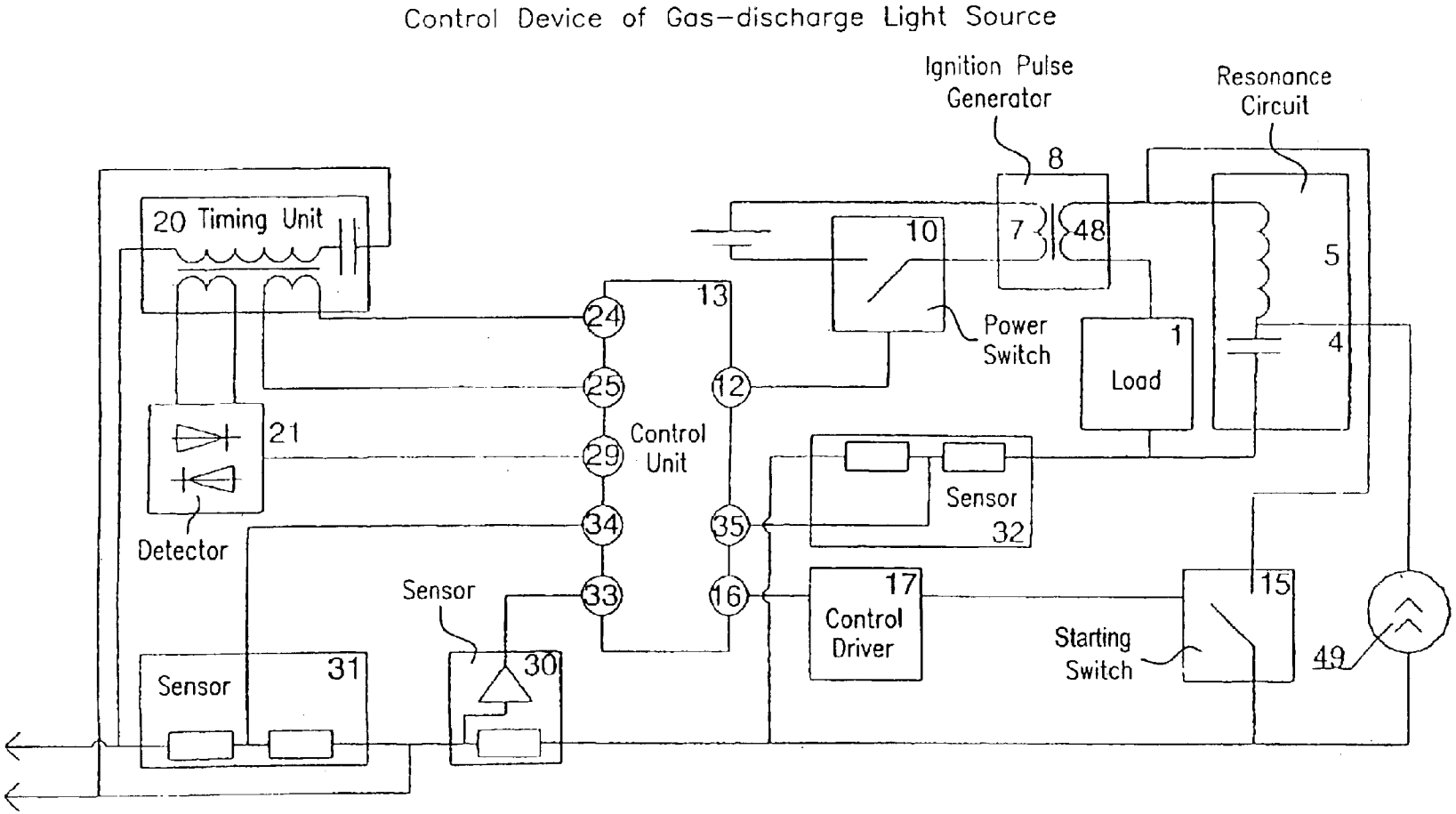
Figure 5:
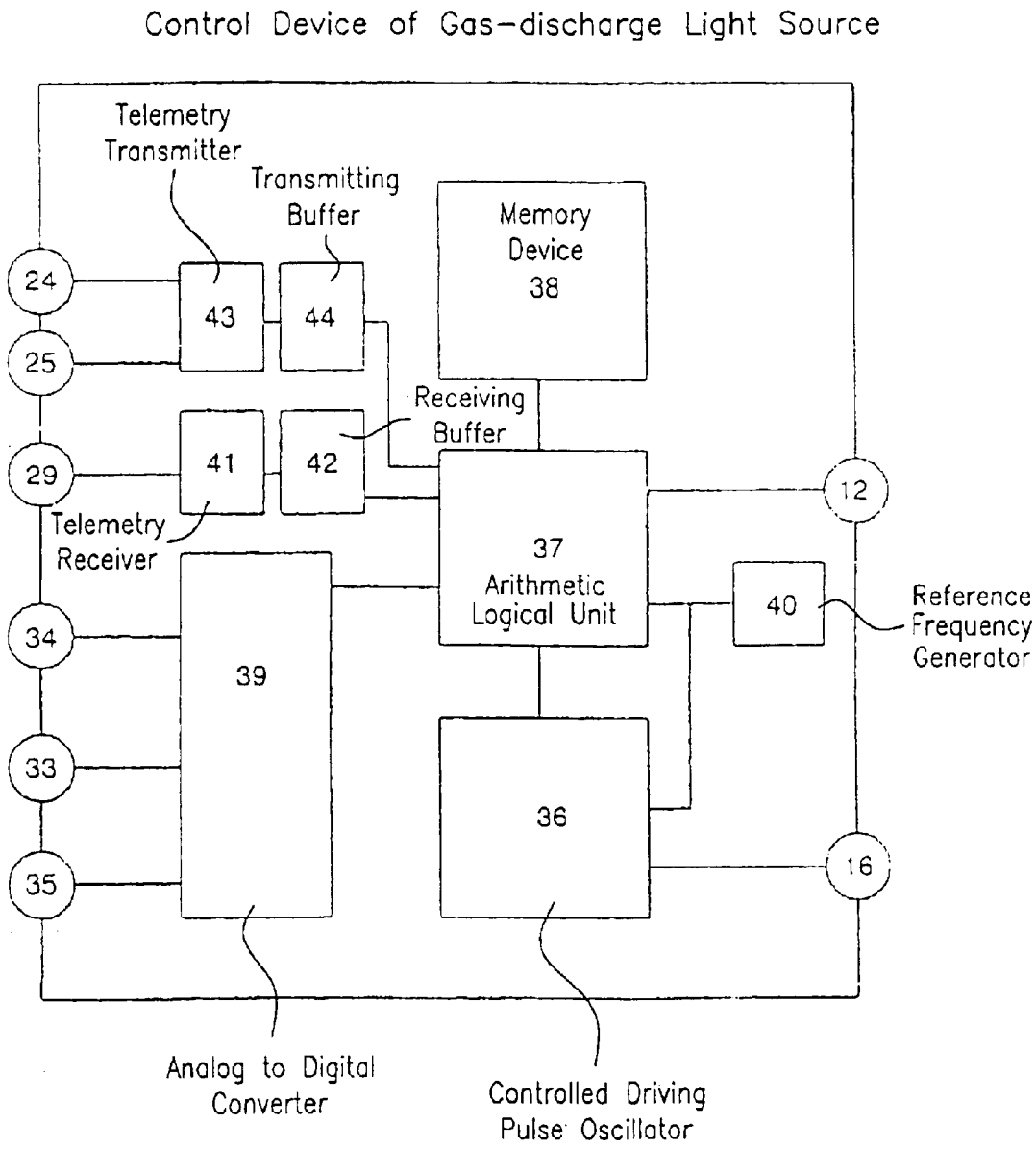

the circuit diagram of device with the L element of the ignition pulse generator made in the form of an inductance coil inductively coupled to the choking coil of the resonance circuit is given in FIG. 2;

the circuit diagram of device with the ignition pulse generator and the choking coil of the resonance designed in the form of transformers, the secondary windings of which are coupled in series to the load, is given in FIG. 3;

the circuit diagram of device with coupled in series load and resonance circuit capacitor, the secondary windings of which are designed in the form of a transformer of the L element of the ignition pulse generator, is given in FIG. 4;

the block diagram of the microprocessor control unit is given in FIG. 5;

DETAILED DESCRIPTION OF THE INVENTION

Figure 1:
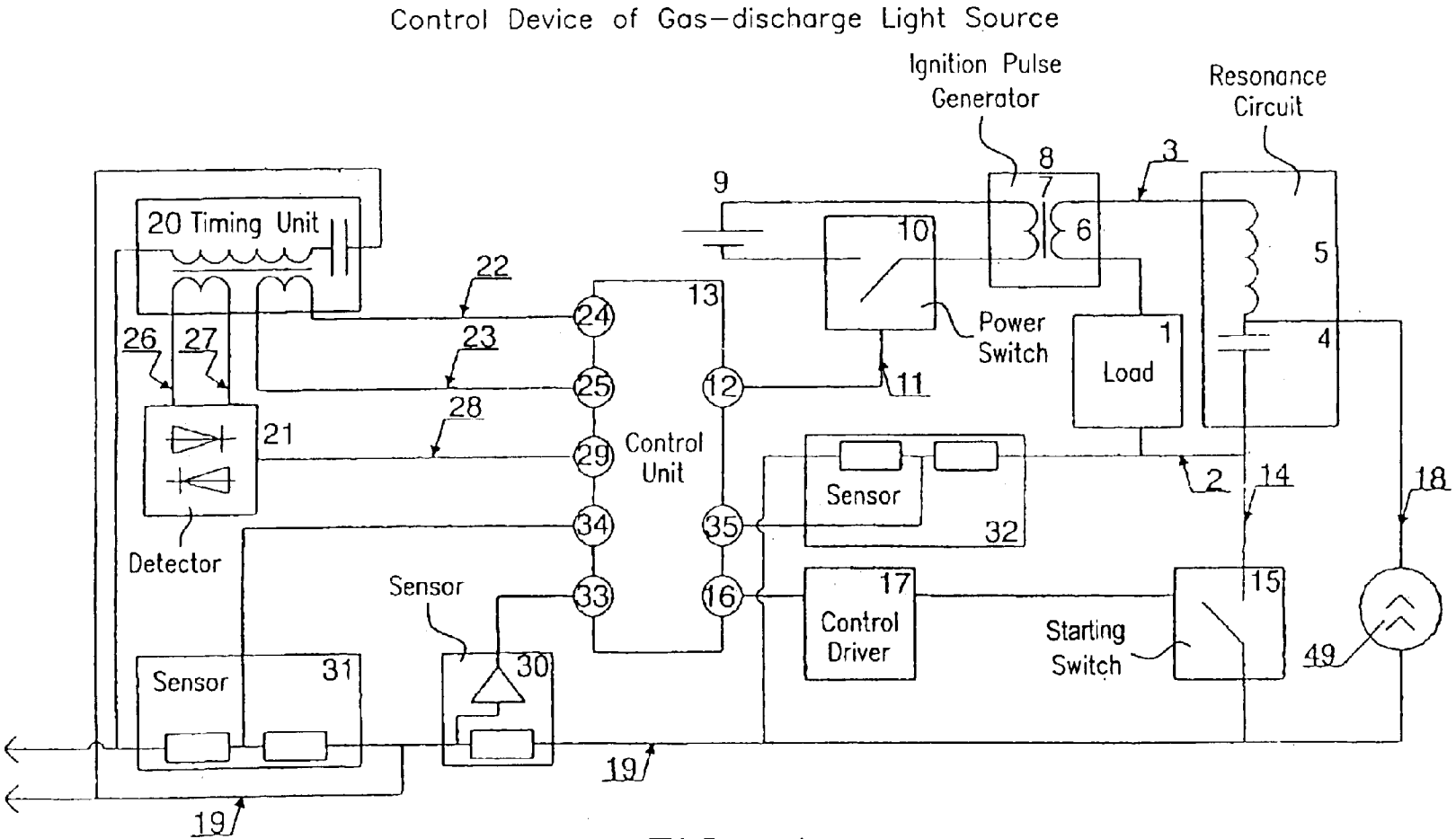

The device includes a load 1 having functional branched coupling (for example, lines 2 and 3 on the diagram in FIG. 1) with capacitor 4 and choking coil 5 making a resonance circuit. On line 2, the secondary winding 6 (connected in series to the load 1 and choke 5) of the L element is made in the form of a transformer 7 of an ignition pulse generator 8. The given generator is connected to a voltage source 9 through a power switch 10 with a control line 11 from terminal 12 of a microprocessor control unit 13.

Power supply of the load 1 and generator 8 is provided by means of line 14 with a starting switch 15 with switching element controlled through terminal 16 of the microprocessor control unit 13 and control driver 17.

Power supply of the resonance circuit is provided on line 18 coming to the junction point of the choking coil 5 and capacitor 4 from a power supply source 49.

The device is equipped with a unit for timing with power supply mains 19 and detector 21 of frequency-modulated signals (for example, double-balanced phase detector on field-controlled transistors).

The first of them is coupled by means of lines 22 and 23 to terminals 24 and 25 of the microprocessor control unit 13, and the second one is coupled inductively by lines 26 and 27 to the timing unit 20, and is galvanically connected by line 28 to the microprocessor control unit 13 through terminal 29.

Elements for current and voltage monitoring in the form of a current sensor 30 and voltage sensor 31 are provided as a means for obtaining check data on the power supply mains 19, and on line 2—elements for the load 1 state control in the form of sensor 32 of circuit state.

Each of the intermediate sensors has connection to the microprocessor control unit 13; sensor 30 through terminal 33, sensor 31 through terminal 34 and sensor 32 through terminal 35, correspondingly.

The microprocessor control unit 13 includes (see FIG. 5) a controlled driving pulse oscillator 36, arithmetic-logical unit 37, memory device 38, multichannel analog-to-digital converter 39 and reference frequency generator 40.

The microprocessor control unit 13 is designed with a line-operated telemetry receiver 41 connected to terminal 29 of the output of a frequency-modulated signals detector 21 and having a receiving buffer 42 at the output into the arithmetic-logical unit 37.

The microprocessor control unit 13 is also designed with a line-operated telemetry transmitter 43 connected to terminals 24 and 25 of the output of a timing unit 20 and having a transmitting buffer 44 at the output into the arithmetic-logical unit 37.

The device shown in FIG. 2 has L element 7 of the ignition pulse generator 8 designed in the form of an inductance coil inductively coupled through iron circuit 45 with the choking coil of the resonance circuit 5 coupled in series to load 1. Such solution increases device reliability owing to reduction of electric couplings number.

The device shown in FIG. 3 has L element 7 of the ignition pulse generator 8 and the choking coil of the resonance circuit 5 designed in the form of transformers, in this case the primary winding 46 of the choking coil 5 is coupled inductively to the secondary winding 47 of L element 7 and to load 1 coupled to it in series. An advantage of this solution is simplicity of the device and load timing.

The device shown in FIG. 4 has L element 7 designed in the form of a transformer with the secondary winding 48 coupled in series to load 1 and the resonance circuit capacitor 4, as a result, protection against passing direct current through the load is ensured.

Assemblage of the microprocessor control unit 13, sensors 30, 31 and 32, driver 17, starting switch 15 and their connections forms a control-and-command circuit.

The device operates in the following way.

After supplying power feeding or pulsating voltage, the microprocessor control unit 13 from time to time interrogates the current sensor 30, voltage sensor 31 and circuit state sensor 32. In case of coincidence of the received signals with the reference ones for transient state, the microprocessor control unit 13 controlling power switch 10 of the ignition pulse generator 8 supplies ignition pulse to the load. At the same time, control unit 13 supplies control repetitive pulse through driver 17 to the control input of the switching element of the starting switch 15. On the base of the characteristic of the signal from the circuit state sensor 32, the control unit 13 identifies circuit transition into steady state.

The control unit 13 performs transmission of data of device operation mode by lines of power supply mains 19 through unit 20 of timing with power supply mains 19, and receives telecontrol commands through timing unit 20 and detector 21 of frequency-modulated signals connected to it. According to the telecontrol commands, control unit 13 changes current program settings determining operation conditions of the device and load parameters. In steady state control unit 13 after a signal of a circuit state sensor 32, current sensor 30 and voltage sensor, sets the period and width of the control pulse so as to prevent mismatch of the resonance circuit formed by branched connection of capacitor 4 and choking coil 5, driving oscillator 36 of control unit 13 and in order to maintain stability of the set load parameters.

What is claimed is:

1. Gas-discharge light source control device includes a gas-discharge lamp as a load, resonance circuit in the form of choking coil and capacitor coupled to the load, an ignition pulse generator with a power controlled switch and (L) element coupled to the load, a power supply mains, and a control command circuit formed by microprocessor control unit with a pulse oscillator, load state control elements, current and voltage level monitoring elements and a starting switch with controlling driver of a switching element, and characterised in that it contains power supply mains timing block, which is galvanically connected to microprocessor control unit and power supply mains, detector of frequency-modulated signals, coupled inductively to power supply mains timing unit and galvanically to the microprocessor control unit, voltage source, connected to ignition pulse generator, whose power control switch is coupled to microprocessor control unit, and electric current source, coupled to power supply mains and resonance circuit located where choking coil and capacitor connect; then current and voltage level control elements are installed into the power supply mains and coupled to microprocessor control unit capable of receiving remote commands, transmitting telemetric signals through the power supply mains and monitoring load parameters, depending on current and voltage of the power supply mains, the level of signals of load state monitoring elements and remote control signals; the starting switch is coupled to the load and through the driver to microprocessor control unit, and load state control elements are connected to load and microprocessor control unit, while the inductive element of the ignition pulse generator is a transformer with its secondary winding being coupled in series to the choking coil of the resonance circuit and to the load.

2. Gas-discharge light source control device includes a gas-discharge lamp as a load, a resonance circuit in the form of choking coil and capacitor coupled to the load, ignition pulse generator with power controlled switch and an (L) element coupled to the load, power supply mains, and a control command circuit formed by a microprocessor control unit with pulse oscillator, load state control elements, current and voltage level monitoring elements and a starting switch with controlling driver of switching element, characterised in that it contains a power supply mains timing block, coupled inductively to the microprocessor control unit and power supply mains, detector of frequency-modulated signals, coupled inductively to power supply mains timing block and galvanically to the microprocessor control unit, a voltage source, connected to ignition pulse generator, whose power control switch is coupled to the microprocessor control unit, and an electric current source, coupled to the power supply mains and the resonance circuit located where choking coil and capacitor connect, then, current and voltage level control elements are installed into the power supply mains and coupled to the microprocessor control unit capable of receiving remote commands, transmitting telemetric signals through the power supply mains and monitoring load parameters, depending on current and voltage of the power supply mains, the level of signals of load state control elements and remote control signals; the starting switch is coupled to the load and through the driver with the microprocessor control unit, and load state control elements are connected with the load and microprocessor control unit, while inductive element of the ignition pulse generator is an inductance coil, while choking coil of resonant circuit is coupled in series to the load and inductively coupled to the inductance coil.

3. Gas-discharge light source control device includes a gas-discharge lamp as a load, a resonance circuit in the form of choking coil and capacitor coupled to the load, ignition pulse generator with power controlled switch and inductive element coupled to the load, power supply mains, and a control command circuit formed by a microprocessor control unit with pulse oscillator, load state control elements, current and voltage level control elements and a starting switch with controlling driver of switching element, characterised in that it contains power mains timing block, coupled inductively to the microprocessor control unit and power supply mains, detector of frequency-modulated signals, coupled inductively to power supply mains timing block and galvanically with the microprocessor control unit, voltage source, connected to ignition pulse generator, whose power control switch is coupled to the microprocessor control unit, and electric current source, coupled to power supply mains and resonance circuit located where choking coil and capacitor connect; then, current and voltage level control elements are installed into the power supply mains and coupled to the microprocessor control unit capable of receiving remote commands, transmitting telemetric signals through the power supply mains and monitoring load parameters, depending on current and voltage of the power supply mains, the level of signals of load state control elements and remote control signals; the starting switch is coupled to the capacitor and secondary winding of the choking coil of the resonance circuit and through the driver with the microprocessor control unit; load state control elements are connected to the starting switch and the microprocessor control unit, while inductive element of the ignition pulse generator and choking coil of resonance circuit are in the form of transformers, and choking coil primary winding is coupled to the load and to the inductive element secondary winding.

4. Gas-discharge light source control device includes a gas-discharge lamp as a load, a resonance circuit in the form of choking coil and a capacitor coupled to the load, ignition pulse generator with power controlled switch and inductive element coupled to the load, power supply mains, and a control command circuit formed by the microprocessor control unit with pulse oscillator, load state control elements, current and voltage level control elements and a starting switch with controlling driver of switching element, characterised in that it contains power supply mains timing block, coupled inductively to the microprocessor control unit and power supply mains, detector of frequency-modulated signals, coupled inductively to power supply mains timing block and galvanically to the microprocessor control unit, a voltage source, connected to the ignition pulse generator, whose power control switch is coupled to the microprocessor control unit, and electric current source, coupled to the power supply mains and resonance circuit located where choking coil and capacitor connect; then, current and voltage level control elements are installed into the power supply mains and coupled to the microprocessor control unit capable of receiving remote commands, transmitting telemetric signals through the power supply mains and monitoring load parameters, depending on current and voltage of the power supply mains, the level of signals of load state control elements and remote control signals; the starting switch is coupled to the load and through the driver with the microprocessor control unit, and load state control elements are connected to the load and microprocessor control unit, while the inductive element of the ignition pulse generator is a transformer with its secondary winding being coupled in series to the load and resonance circuit capacitor.

* * * * *